US007576291B2

(12) United States Patent
Tseng et al.

(10) Patent No.: US 7,576,291 B2
(45) Date of Patent: Aug. 18, 2009

(54) KEY BUTTON MECHANISM AND AN ELECTRONIC DEVICE USING THE SAME

(75) Inventors: Chao-Kun Tseng, Tu-Cheng (TW); Kai-Po Chan, Tu-Cheng (TW); Chao-Yuan Cheng, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 0 days.

(21) Appl. No.: 12/164,252

(22) Filed: Jun. 30, 2008

(65) Prior Publication Data

US 2009/0159416 A1 Jun. 25, 2009

(30) Foreign Application Priority Data

Dec. 24, 2007 (CN) ..... 200710203369

(51) Int. Cl.
*H01H 13/02* (2006.01)

(52) U.S. Cl. ..... 200/296; 200/517; 200/341

(58) Field of Classification Search ..... 200/406, 200/516, 517, 341, 344, 345, 292–296; 341/20, 341/22; 345/156, 168, 169, 173, 184
See application file for complete search history.

(56) References Cited

U.S. PATENT DOCUMENTS 5,253,142 A * 10/1993 Weng ..... 361/679.56
5,746,307 A * 5/1998 Joss et al. ..... 200/303
6,967,299 B2 * 11/2005 Howie et al. ..... 200/512
7,164,091 B2 * 1/2007 Lu ..... 200/292
7,173,205 B2 * 2/2007 Yamamoto ..... 200/343
7,268,312 B2 * 9/2007 Chen ..... 200/343
7,279,650 B2 * 10/2007 Yamaguchi ..... 200/314
7,405,373 B2 * 7/2008 Konishi et al. ..... 200/517
7,408,128 B2 * 8/2008 Watanabe ..... 200/329
7,414,212 B2 * 8/2008 Huang ..... 200/334

* cited by examiner

*Primary Examiner*—Michael A Friedhofer
(74) *Attorney, Agent, or Firm*—Steven M. Reiss

(57) ABSTRACT

A key button mechanism (100) including an operating body (10), a flexible circuit board (20), a fixing device (40), and a mounting assembly (50) is provided. The flexible circuit board engages with the operating body. The fixing device includes a hanging body (42) and a fixing base (44), and the hanging body is hung on the fixing base. The flexible circuit board is attached to the hanging body. The mounting assembly includes a cover (52) and a mounting portion (54) configured for mounting the fixing base thereon. The hanging body of the fixing device is configured for resisting the mounting portion. An electronic apparatus incorporating the key button mechanism is also provided.

18 Claims, 5 Drawing Sheets

KEY BUTTON MECHANISM AND AN ELECTRONIC DEVICE USING THE SAME

BACKGROUND OF THE INVENTION

1. Field of the Invention

The present invention relates to a key button mechanism and particularly to an electronic device equipped with the key button mechanism.

2. Discussion of the Related Art

With rapid development of information technology, electronic devices, such as cellular phones, personal digital assistant (PDA), and so on, are become more and more popular. For conventional electronic devices, buttons may be arranged on two side surfaces of the electronic devices, hereinafter referred to as side-buttons, and configured for providing command shortcuts. For example, the side-buttons can be used for receiving a call, adjusting sound volume, and so on. Side-button designs significantly contribute to easier operations of the electronic devices.

The general side-buttons of the electronic devices can be sliding structure or pressing structure. For the sliding structure, the side-button slides along a sliding groove to activate or deactivate switches of the electronic devices. However, it is difficult to cover this kind of sliding groove, and thus may affect the overall appearance of the electronic devices. As a result, the side-button with pressing structure is more practical than the sliding structure.

Conventional side-buttons include an operating body, a flexible board, and a mounting portion for mounting the flexible board thereon. The mounting portion is arranged on a side surface of an electronic device. When assembled, one end of the flexible board is soldered on a circuit board of the electronic device, and then inversely folded toward the mounting portion to engage with the operating body. However, the above assembly process makes it difficult to mount the flexible board onto the mounting portion. In addition, because the mounting portion is made of plastic material, for being integrally formed with a housing of the electronic device, the static electricity generated during use of the side-buttons may cause electrical interference for the electronic devices.

Therefore, a new key button mechanism and an electronic device equipped with the key button mechanism are desired in order to overcome the above-described problems.

BRIEF DESCRIPTION OF THE DRAWINGS

Many aspects of the key button mechanism can be better understood with reference to the following drawings. The components in the drawings are not necessarily to scale, the emphasis instead being placed upon clearly illustrating the principles of the present key button mechanism. Moreover, in the drawings, like reference numerals designate corresponding parts throughout the several views.

DETAILED DESCRIPTION OF THE EMBODIMENTS

Figure 1:
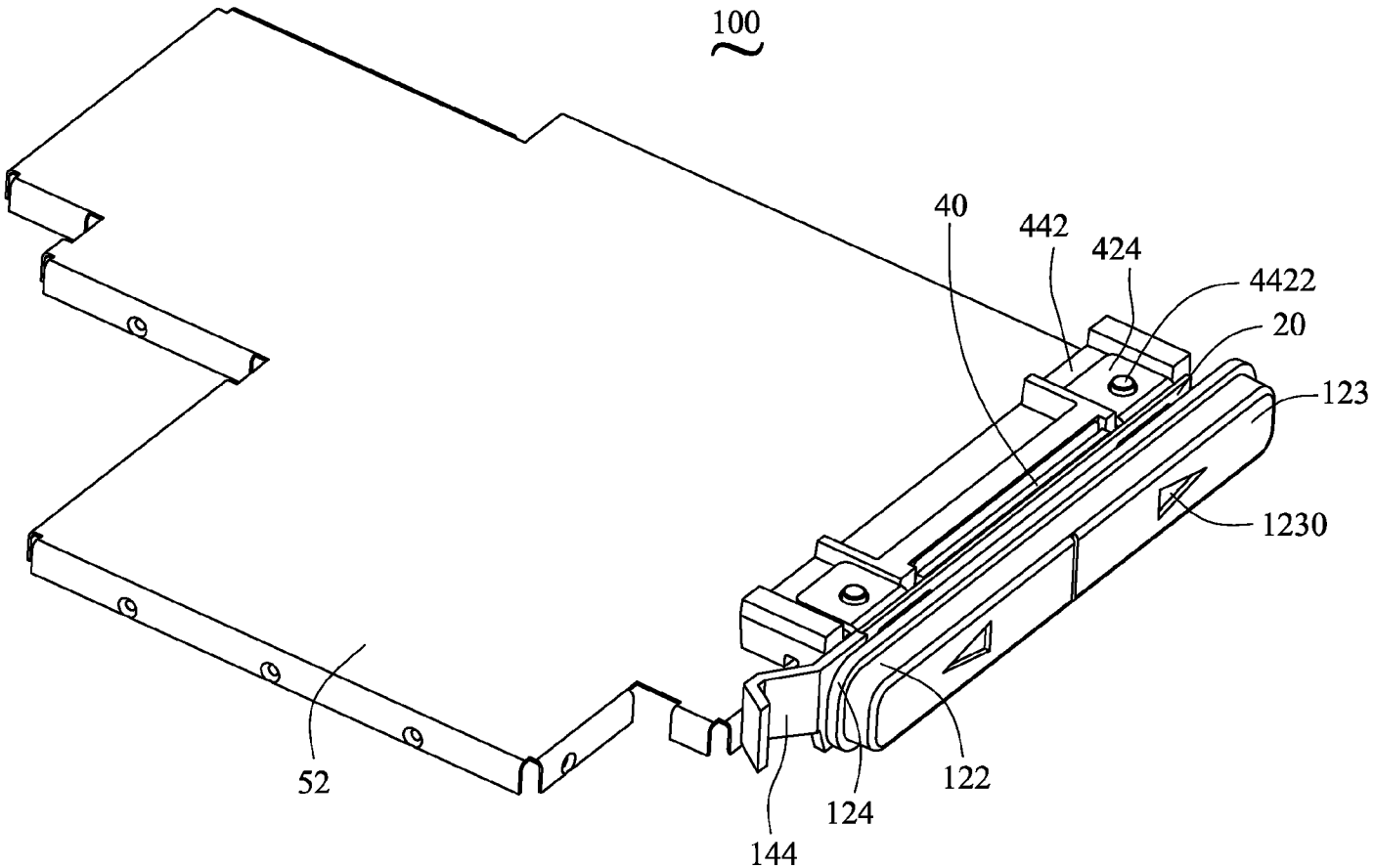
FIG. 1 is an overall isometric view of the present key button mechanism according to an exemplary embodiment.
Figure 2:
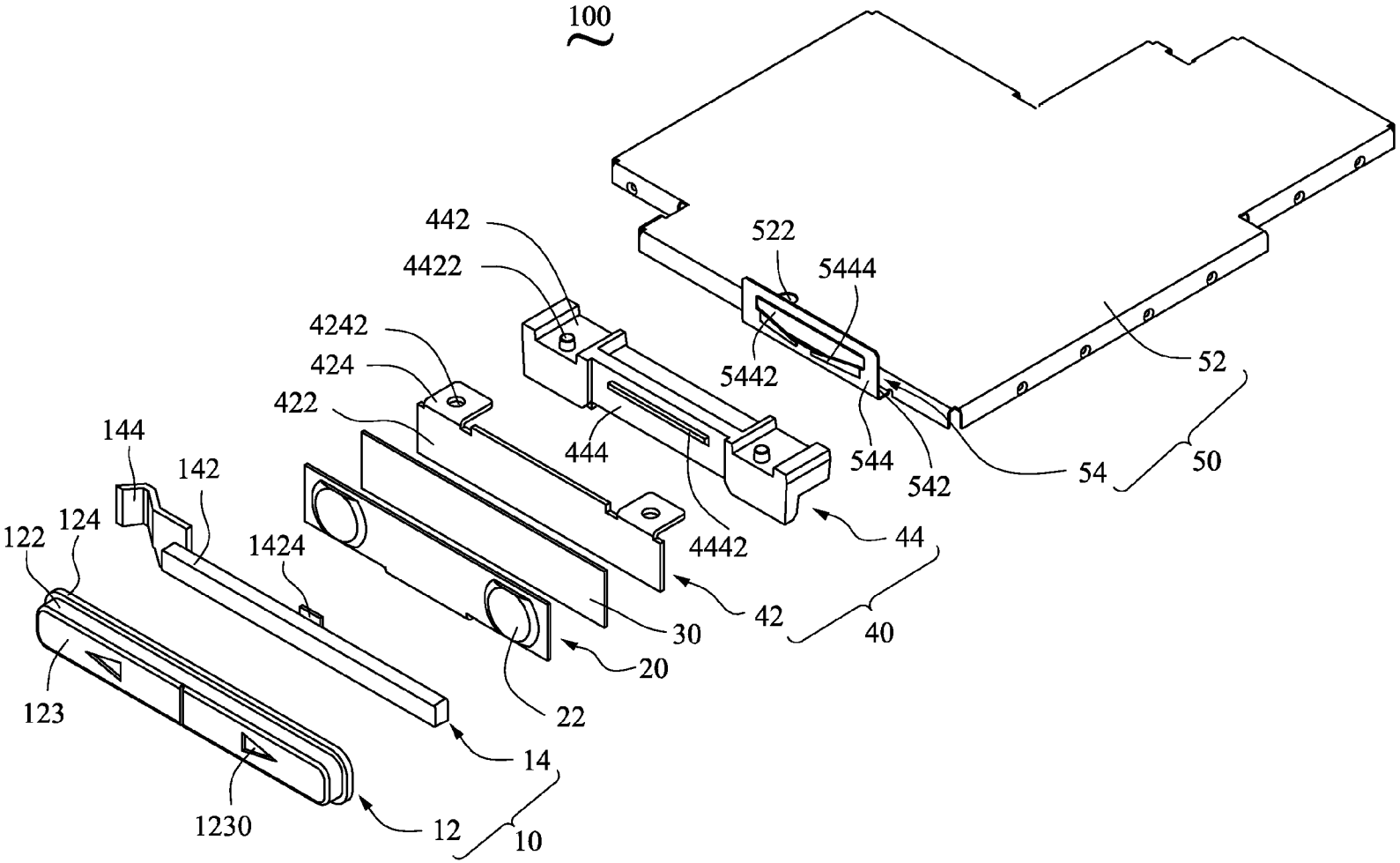
FIG. 2 is an exploded isometric view of the key button mechanism of FIG. 1.
Figure 3:
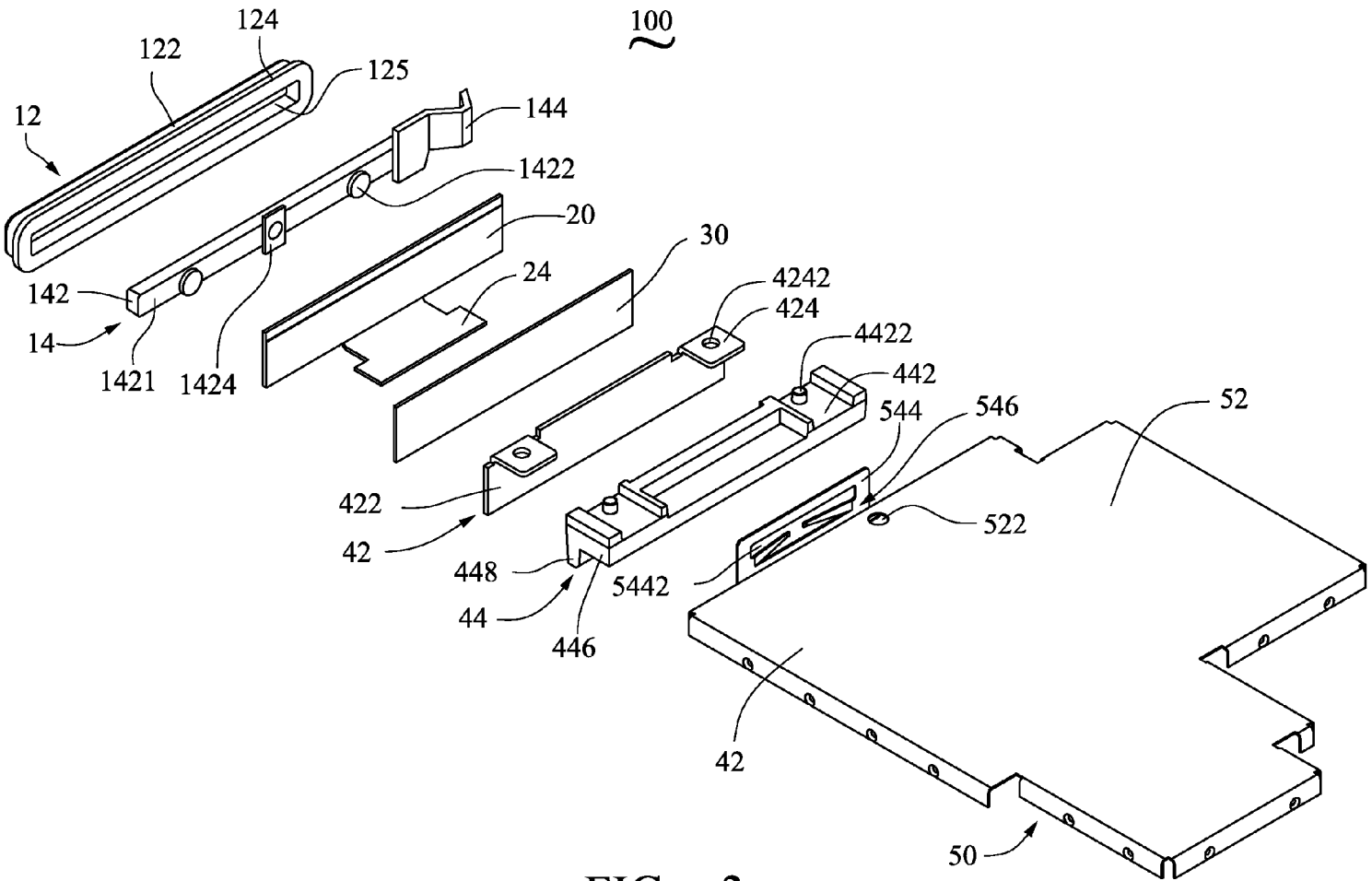
FIG. 3 is an exploded isometric view of the key button mechanism of FIG. 1, but viewed from another aspect.

FIGS. 1-3 show a key button mechanism 100. The key button mechanism 100 includes an operating body 10, a flexible circuit board 20, an adhesive layer 30, a fixing device 40 and a mounting assembly 50.

The operating body 10 includes an operating cover 12 and a pressing body 14. The operating cover 12 includes a body 122, a pressing surface 123, and a peripheral edge 124. Users may operate the key button mechanism 100 via the pressing surfaces 123. The peripheral edge 124 extends from edges of the body 122 and defines a recessed engaging slot 125 (refer to FIG. 3) for lockably engaging with a housing of an electronic device (not shown).

The pressing body 14 includes a body portion 142 and an elastic portion 144 connected to one side of the body portion 142. The body portion 142 is substantially rectangular. The size of the body portion 142 equals the size of the engaging slot 125 (FIG. 3) of the operating cover 12 so the body portion 142 may be received in the engaging slot 125. Two resisting protrusions 1422 and a supporting block 1424 are arranged on a surface 1421 of the body portion 142. However, the number of the resisting protrusions 1422 may be more than two according to the number of required side-buttons. The resisting protrusions 1422 are substantially cylindrical, and are spaced from each other. The supporting block 1424 is substantially square, and is arranged in the central portion of the surface 1421. Thickness of the supporting block 1424 is larger than that of the resisting protrusions 1422. The elastic portion 144 is a bent elastic sheet attaching to the surface 1421.

The flexible circuit board 20 includes two contact switches 22 and a bent edge 24. The contact switches 22 are arranged on a surface adjacent to the pressing body 14, and are correspondingly arranged with the resisting protrusions 1422 of the pressing body 14. Accordingly, the contact switches 22 are able to operate in accordance with the resisting protrusions 1422. In addition, the number of the contact switches 22 may vary according to the number of the resisting protrusions 1422. The bent edge 24 is perpendicular to the surface of the flexible circuit board 20, and configured for connecting the flexible circuit board 20 to a circuit board 60 (refer FIG. 5) to provide electrical connection between circuit board 20 and circuit board 60.

The adhesive layer 30 is configured for attaching the flexible circuit board 20 to the fixing device 40. In alternative embodiment, the flexible circuit board 20 may be attached to the fixing device 40 by other methods without the adhesive layer 30, such as attaching the flexible circuit board 20 to the fixing device 40 using screws.

The fixing device 40 includes a hanging body 42 and a fixing base 44. The hanging body 42 is made of conductive material, such as iron or aluminum. The hanging body 42 includes a main board 422 and two clasping portions 424. The main board 422 is parallel to the adhesive layer 30, and is configured to be attached to the flexible circuit board 20 by the adhesive layer 30. The clasping portions 424 extend from two opposite sides of an upper end of the main board 422, and are substantially perpendicular to the main board 422. In addition, each middle portion of clasping portion 424 defines a circular hanging aperture 4242.

The fixing base 44 is a substantially rectangular body. Each side of a top surface of fixing base 44 defines a recessed section 442. A cylindrical protruding post 4422 is arranged in each of the recessed sections 442. The protruding posts 4422 are configured for engaging with the hanging apertures 4242 of the hanging body 42 to suspend the hanging body 42 from the fixing base 44.

Figure 4:
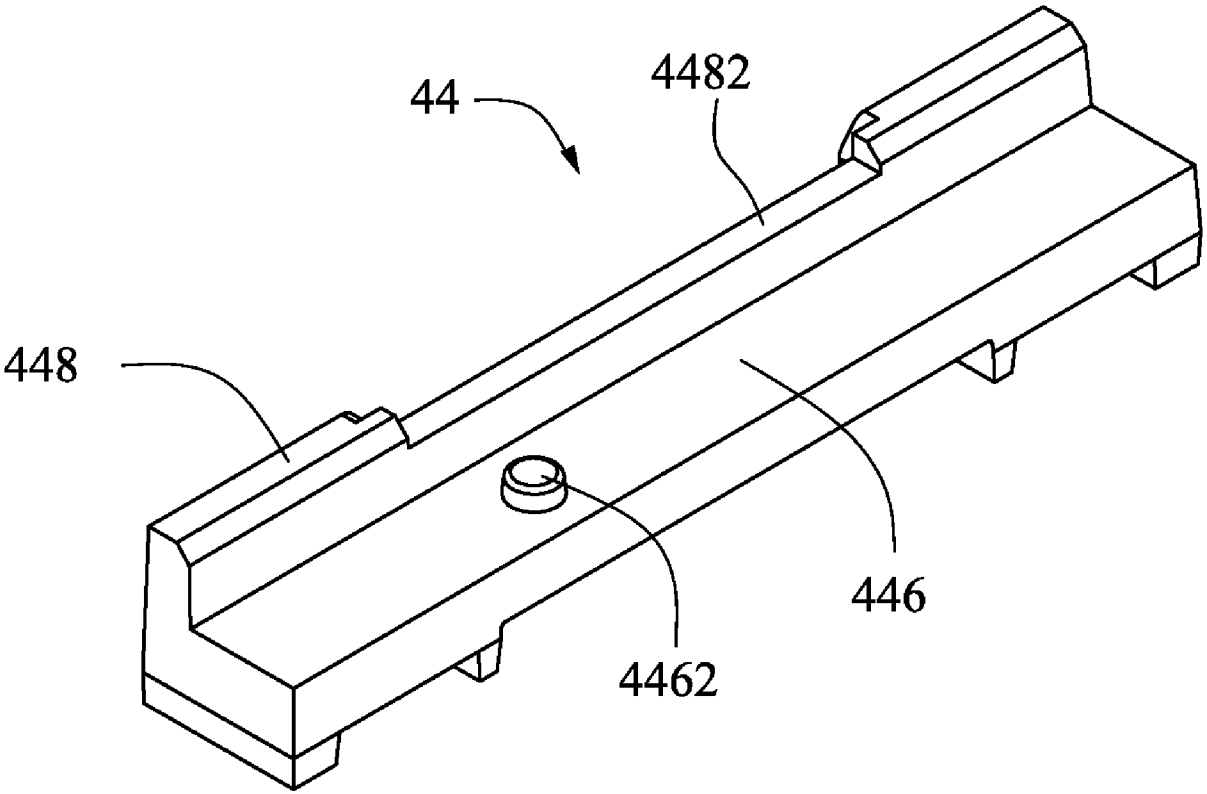
FIG. 4 is an enlarged isometric view of the fixing base of the key button mechanism of FIG. 1.

Referring to FIG. 2, a lateral surface of the fixing base 44 defines a slot 444. A flange 4442 is protrusively arranged on the slot 444. The flange 4442 is substantially rectangular-shaped, and the height of the flange 4442 is the same with the depth of the slot 444. FIG. 4 shows the fixing base 44 flipped vertically. A bottom surface of the fixing base 44 is substantially stepped-shaped including a first stepped portion 446 and a second stepped portion 448. A cylindrical protrusion 4462 is arranged on a top surface of the first stepped portion 446, and a recessed section 4482 is defined on a central portion of the second stepped portion 448.

The mounting assembly 50 is formed by punching a sheet of conductive material, such as metal. The mounting assembly 50 includes a cover 52 and a mounting portion 54 integrally formed with the cover 52. The cover 52 covers electronic elements on a printed circuit board. The structure of the cover 52 is substantially frame-like, and the thickness of the cover 52 equals the height of the first stepped portion 446 of the fixing base 44. A circular through hole 522 is defined on a top surface of the cover 52 for engaging with the protrusion 4462 of the first stepped portion 446 (refer to FIG. 4).

The mounting portion 54 is a substantially L-shaped metallic sheet mounted on a bottom surface of the cover 52 with a protruding portion of the metallic sheet protruding out from the cover 52. The protruding portion of the metallic sheet is bent upward to form the L-shape. The mounting portion 54 includes a horizontal section 542 and a vertical section 544. The horizontal section 542, the vertical section 544 and the cover 52 cooperatively define a receiving groove 546 (refer to FIG. 3). The width of the horizontal section 542 equals the length of recessed section 4482.

A rectangular notch 5442 for engaging with the flange 4442 of the slot 444 of the fixing base 44 is defined in the vertical section 544. Further, two elastic strips? 5444 are arranged below the notch 5442, and protrude from the notch 5442 in the opposite direction relative to the cover 52. The elastic strips 5444 are configured for resisting the hanging body 42 after the fixing base 44 is assembled to the mounting assembly 50. Accordingly, the static electricity generated between the operating body 10, the flexible circuit board 20, and the housing of the electronic device may be introduced to cover 52 to eliminate the static electricity.

Referring to FIGS. 3 and 4, the second stepped portion 448 of the fixing base 44 is configured to be received in the receiving groove 546 of the mounting assembly 50. The first stepped portion 446 of the fixing base 44 is configured for resisting the top surface of the cover 52 after the fixing base 44 is assembled to the mounting assembly 50. The protrusion 4462 of the first stepped portion 446 is engaged with the through hole 522 of the cover 52. The flange 4442 is engaged with the notch 5442. In this way, the fixing base 44 is disposed above the mounting assembly 50.

The flexible circuit board 20 is attached to the main board 422 of the hanging body 42 using the adhesive layer 30. The clasping portions 424 of the hanging body 42 are engaged with the recessed sections 442 of the fixing base 44, and the protruding posts 4422 of the recessed sections 442 are engaged with the hanging apertures 4242 of the clasping portions 424 to suspend the hanging body 42 on the fixing base 44. The elastic strips 5444 (refer to FIG. 2) of the mounting portion 54 of the mounting assembly 50 are configured for resisting the main board 422 of the hanging body 42. The body portion 142 of the pressing body 14 is then received within the engaging slot 125 of the operating cover 12 to accomplish the assembly of the operating body 10.

Figure 5:
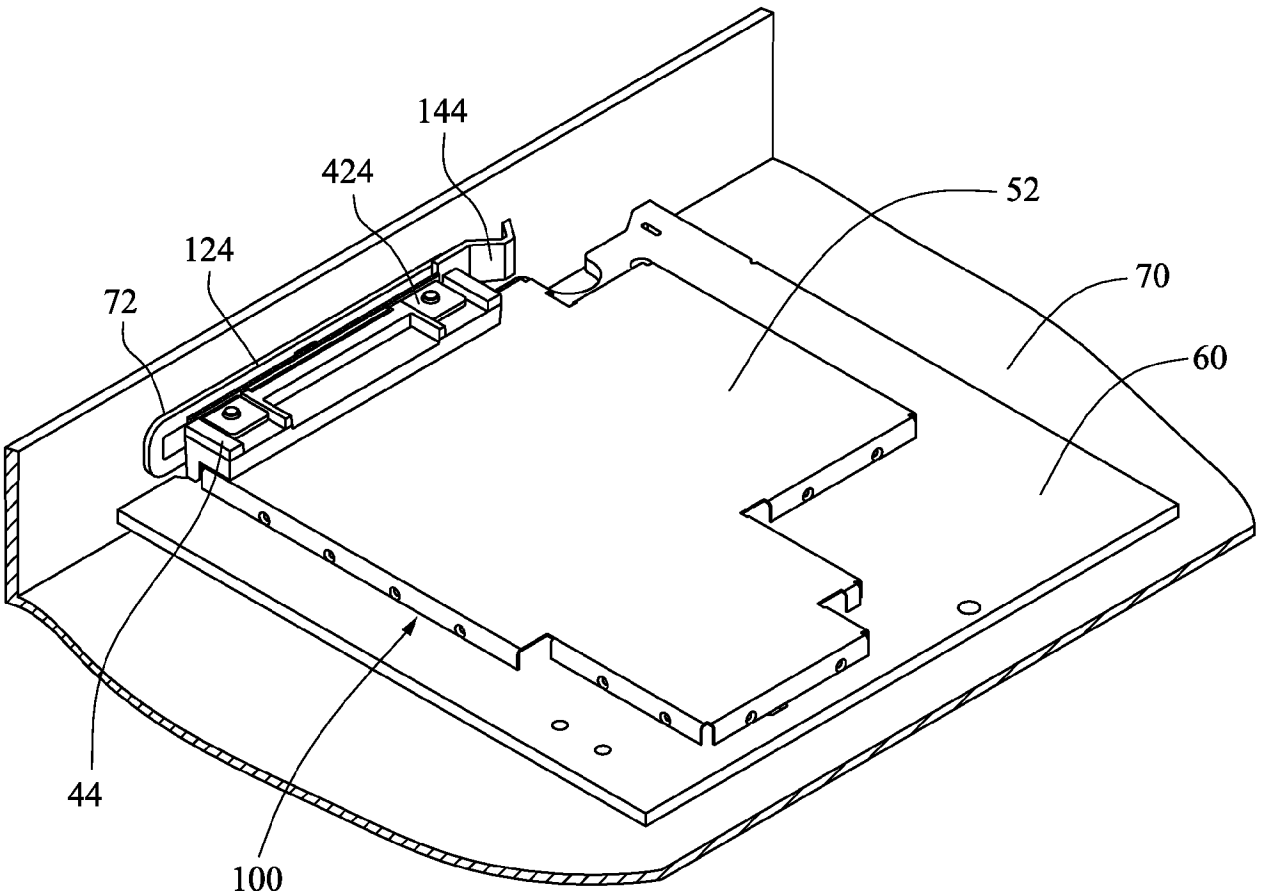
FIG. 5 is an assembled isometric view of an electronic device employing the key button mechanism of FIG. 1.

Referring also to FIG. 5, the assembled key button mechanism 100 is assembled to the circuit board 60 arranged within a housing 70 of an electronic device. A button slot 72 is defined by a side surface of the housing 70. The size of the button slot 72 is equivalent to the size of the body 122 to engage the button slot 72 with the body 122. After that, the operating body 10 is assembled to the button slot 72. The supporting block 1424 of the pressing body 14 of the operating body 10 is configured for resisting the middle portion of the flexible circuit board 20. The recessed engaging slot 125 of the operating cover 12 prevents the operating cover 12 from being detached from the housing 70.

In order to activate the circuits within the flexible circuit board 20, the pressing surfaces 123 of the operating cover 12 are pressed, and then the resisting protrusions 1422 of the pressing body 14 resists the contact switches 22 to activate the circuits within the flexible circuit board 20. At the same time, the elastic portion 144 of the pressing body 14 resists a lateral side of the circuit board 60 or the housing 70 to accumulate elastic energy. The circuits within the flexible circuit board 20 are turned off when the user stop pressing the pressing surfaces 123.

In the exemplary embodiment, the flexible circuit board 20 is attached to the hanging body 42 using the adhesive layer 30. The hanging body 42 is then suspended on the fixing base 44 after the fixing device 44 is assembled to the mounting assembly 50. Therefore, it is more convenient to locate the flexible circuit board 20 than the conventional method of inversely folding the flexible circuit board. In addition, the mounting assembly 50 and the hanging body 42, which is configured for elastically resisting the mounting assembly 50, are made of metallic material. The mounting assembly 50 may also function as electromagnetic shielding such that the static electricity generated during use of the electronic device may be eliminated in time.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A key button mechanism, comprising:

an operating body;

a flexible circuit board, the flexible circuit board engaging with the operating body;

a fixing device comprising a hanging body and a fixing base, the hanging body hung from the fixing base, and the flexible circuit board being attached to the hanging body; and a mounting assembly comprising a cover and a mounting portion, the mounting portion being configured for mounting the fixing base thereon, and the hanging body of the fixing device being configured for resisting the mounting portion.

2. The key button mechanism as claimed in claim 1, wherein the operating body further comprises an operating cover and a pressing body, the operating cover defines an engaging slot, the pressing body includes a body portion, the body portion is received in the engaging slot such that the pressing body is joined to the operating cover.

3. The key button mechanism as claimed in claim 2, wherein the pressing body includes a plurality of resisting protrusions disposed one side thereof, and an elastic portion disposed one end of an opposite side thereof, the flexible board includes a plurality of contact switches arranged thereon, the resisting protrusions engaging with the contact switches.

4. The key button mechanism as claimed in claim 1, wherein the flexible circuit board further comprises a bent edge perpendicular to a surface of the flexible circuit board and is configured for connecting the flexible circuit board to a circuit board.

5. The key button mechanism as claimed in claim 1, wherein the key button mechanism further comprises an adhesive layer for attaching the flexible circuit board to the fixing device.

6. The key button mechanism as claimed in claim 1, wherein the hanging body includes a main board and two clasping portions extending from two opposite sides of an upper end of the main board and are perpendicular to the main board, and two circular hanging apertures are defined in the clasping portions.

7. The key button mechanism as claimed in claim 6, wherein the fixing base includes two recessed sections defined on a top surface, a protruding post is arranged in each of the recessed section for engaging with circular hanging apertures of the hanging body, and a flange is defined in the slot for engaging with the mounting portion.

8. The key button mechanism as claimed in claim 1, wherein a bottom surface of the fixing base includes a first stepped portion and a second stepped portion, and a protrusion is arranged on a horizontal surface of the first stepped portion for engaging with a through hole defined on the cover of the mounting assembly.

9. The key button mechanism as claimed in claim 1, wherein the mounting portion further comprises a vertical section and a horizontal section, the vertical section, the horizontal section and the cover cooperatively define a receiving groove for accommodating the fixing base.

10. The key button mechanism as claimed in claim 9, the vertical section further comprises a notch and two elastic strips arranged below the notch, the notch is for engaging with the fixing base, and the elastic strips is for resisting the hanging body.

11. The key button mechanism as claimed in claim 1, wherein a thickness of the cover equals the height of the first stepped portion.

12. An electronic apparatus comprising:

a housing for covering a circuit board within the electronic apparatus, the housing includes a key slot arranged thereon;

a key button mechanism including an operating pressing body, a flexible circuit board, a fixing device, a mounting assembly, the flexible circuit board for engaging with the operating body includes a plurality of contact switches arranged thereon and is configured for engaging with the pressing body, the fixing device further comprises a fixing base and a hanging body hung on the fixing base, and the flexible circuit board is attached to the hanging body, the mounting assembly further comprises a cover and a mounting portion, the mounting portion is configured for mounting the fixing base thereon, and the hanging body is configured for resisting the mounting portion; and wherein the pressing body being engaged with and being clasped within the key slot, the fixing device is arranged in accordance with a location of the key slot, and the mounting assembly is arranged on the circuit board.

13. The electronic apparatus as claimed in claim 12, wherein the operating body further comprises an operating cover and a pressing body, the operating cover defines an engaging slot, the pressing body includes a body portion, the body portion is received in the engaging slot such that the pressing body is joined to the operating cover.

14. The electronic apparatus as claimed in claim 13, wherein the pressing body includes a plurality of resisting protrusions disposed one side thereof, and an elastic portion disposed one end of an opposite side thereof, the flexible board includes a plurality of contact switches arranged thereon, the resisting protrusions engaging with the contact switches.

15. The electronic apparatus as claimed in claim 12, wherein the flexible circuit board further comprises a bent edge perpendicular to a surface of the flexible circuit board and is configured for connecting the flexible circuit board to a circuit board.

16. The electronic apparatus as claimed in claim 12, wherein the hanging body includes a main board and two clasping portions extending from two opposite sides of an upper end of the main board and are perpendicular to the main board, and two circular hanging apertures are defined in the clasping portions.

17. The electronic apparatus as claimed in claim 12, wherein the fixing base includes two recessed sections defined on a top surface and a slot defined on a lateral surface, a protruding post is arranged in each of the recessed section for engaging with circular hanging apertures of the hanging body, and a flange is defined in the slot for engaging with the mounting portion.

18. The electronic apparatus as claimed in claim 12, wherein a bottom surface of the fixing base includes a first stepped portion and a second stepped portion, and a protrusion is arranged on a horizontal surface of the first stepped portion for engaging with a through hole defined on the cover of the mounting assembly.

* * * * *